US005512982A

United States Patent [19]

Takahashi et al.

[11] Patent Number: 5,512,982

[45] Date of Patent: Apr. 30, 1996

[54] IMAGE-FORMING APPARATUS WITH A PHOTOSENSITIVE MEMBER AND A CHARGING DEVICE HAVING AN OSCILLATORY VOLTAGE SOURCE

[75] Inventors: Masashi Takahashi; Shigeru Fujiwara, both of Kanagawa; Minoru Yoshida, Tokyo; Takeshi Watanabe, Chiba, all of Japan

[73] Assignee: Kabushiki Kaisha Toshiba, Kawasaki, Japan

[21] Appl. No.: 252,179

[22] Filed: Jun. 1, 1994

[30] Foreign Application Priority Data

Jul. 13, 1993 [JP] Japan ..... 5-173058

[51] Int. Cl.[6] ..... G03G 15/02

[52] U.S. Cl. ..... 355/219; 361/225

[58] Field of Search ..... 355/219, 222, 355/271, 246, 203, 204, 208; 361/225, 221

[56] References Cited

U.S. PATENT DOCUMENTS

| | | | |
|---|---|---|---|
| 4,727,453 | 2/1988 | Ewing | 361/225 |
| 5,126,913 | 6/1992 | Araya et al. | 361/225 |
| 5,146,281 | 9/1992 | Kisu | 355/219 |
| 5,177,534 | 1/1993 | Kisu et al. | 355/219 |
| 5,221,946 | 6/1993 | Kohyama | 355/270 |
| 5,351,109 | 9/1994 | Haneda | 355/219 |

FOREIGN PATENT DOCUMENTS

| | | |
|---|---|---|
| 60-220587 | 11/1986 | Japan . |
| 63-167380 | 7/1988 | Japan . |
| 3-101764 | 4/1991 | Japan . |

*Primary Examiner*—A. T. Grimley
*Assistant Examiner*—Thu Dang
*Attorney, Agent, or Firm*—Foley & Lardner

[57] ABSTRACT

An image-forming apparatus for forming an image, especially a halftone image, by using a photosensitive member, having a charging member for charging the photosensitive member, a mechanism for relatively moving the charging member and the photosensitive member, a voltage source for applying an oscillatory voltage to the charging member such that a Vp/f ratio is about from 0.08 to 0.42, wherein the Vp represents a relative moving speed between the charging member and the photosensitive member and the f represents a frequency of the oscillatory voltage, an exposing member for exposing the charged photosensitive member to form an electrostatic latent image, and a developing unit for developing the electrostatic latent image.

7 Claims, 11 Drawing Sheets

(V)
SURFACE POTENTIAL OF PHOTOCONDUCTIVE DRUM
-640
-560
-480
Vp/f
SURFACE POTENTIAL JUST AFTER CHARGING

-350
-300
-250
SURFACE POTENTIAL JUST AFTER EXPOSING
0
PD

TONER IMAGE AFTER DEVELOPMENT
LOW DENSITY AREA
HIGH DENSITY AREA

FIG. 7

ROTATING SPEED Vp = 125mm/SEC

| FREQUENCY [Hz] | 2000 | 1500 | 1000 | 400 | 300 | 200 |
|---|---|---|---|---|---|---|
| Vp/f [mm/cycle] | 0.063 | 0.083 | 0.13 | 0.31 | 0.42 | 0.63 |
| PAIR NUMBER/mm | 15.9 | 12 | 8 | 3.2 | 2.38 | 1.6 |
| RESULT | × | △ | ○ | ○ | △ | × |

○ GOOD
△ SO-SO
× BAD

FIG. 8

ROTATING SPEED Vp = 420mm/SEC

| FREQUENCY [Hz] | 6000 | 5000 | 4000 | 1200 | 1000 | 800 |
|---|---|---|---|---|---|---|
| Vp/f [mm/cycle] | 0.07 | 0.08 | 0.11 | 0.35 | 0.42 | 0.53 |
| PAIR NUMBER /mm | 14.3 | 11.9 | 9.5 | 2.86 | 2.38 | 1.9 |
| RESULT | × | △ | ○ | ○ | △ | × |

○ GOOD
△ SO-SO
× BAD

FIG. 9

ROTATING SPEED Vp = 50mm/SEC

| FREQUENCY [Hz] | 700 | 600 | 500 | 400 | 150 | 120 | 100 |
|---|---|---|---|---|---|---|---|
| Vp/f [mm/cycle] | 0.07 | 0.08 | 0.1 | 0.13 | 0.33 | 0.42 | 0.5 |
| PAIR NUMBER/mm | 14 | 12 | 10 | 8 | 3 | 2.4 | 2 |
| RESULT | × | △ | ○ | ○ | ○ | △ | × |

○ GOOD
△ SO-SO
× BAD

IMAGE-FORMING APPARATUS WITH A PHOTOSENSITIVE MEMBER AND A CHARGING DEVICE HAVING AN OSCILLATORY VOLTAGE SOURCE

BACKGROUND OF THE INVENTION

1. Field of the Invention

The present invention relates to an image-forming apparatus which is capable of forming a high-quality halftone image. More specifically, the invention relates to an electrophotographic image-forming apparatus having a charging device which charges a photosensitive member by using a oscillatory voltage source.

2. Description of the Related Art

Recently, image-forming apparatuses, e.g., plain paper copying machines, having a function which forms a high-quality halftone image corresponding to photographs and gravure, close to an image formed by an off-set printing machine, are requested. When the image formed by this type image-forming apparatus includes a low density area and a medium density area which is a halftone area, the image is not very good. Therefore, it is important to improve the reproducibility of the image for these density areas.

As one method which responds to this request, a screen method is disclosed by TRIKEPPS CO. LTD. "COLOR HARD COPY PRINT TECHNOLOGY," published Dec. 22, 1987. The screen method has a characteristic in an exposure process. An image-forming apparatus using the screen method has a halftone screen inserted between a photosensitive member and an original. This image-forming apparatus forms an electrostatic latent image which is decomposed into many dots, on the photosensitive member. As a result, the reproducibility of the image for the medium density area is improved.

However, the screen method has problems which are a reduction of the maximum density, a reduction of the resolution, and a reduction of the reproducibility of a character image.

SUMMARY OF THE INVENTION

Accordingly, it is an object of the invention to provide an image-forming apparatus that can form a high-quality halftone image without the reduction of the maximum density, the reduction of the resolution, and a reduction of the reproducibility of a character image.

In accordance with the present invention, the foregoing objects, among others, are achieved by providing an image-forming apparatus, comprising: a charger for charging the photosensitive member; an assembly for relatively moving the charger, and the photosensitive member; circuitry for applying an oscillatory voltage to the charger such that a Vp/f ratio is from 0.08 to 0.42, wherein the Vp represents a relative moving speed between the charger and the photosensitive member and the f represents a frequency of the oscillatory voltage; an exposer for exposing the charged photosensitive member to form an electrostatic latent image; and a developer for developing the electrostatic latent image.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein:

FIG. 7 shows a result of a TEST 1 which attempts to find out a preferable range of a frequency for charging the photosensitive drum;

FIG. 8 shows a result of a TEST 2 which attempts to find out a preferable range of a frequency for charging the photosensitive drum;

FIG. 9 shows a result of a TEST 3 which attempts to find out a preferable range of a frequency for charging the photosensitive drum;

DETAILED DESCRIPTION OF THE PREFERRED EMBODIMENTS

Figure 1:
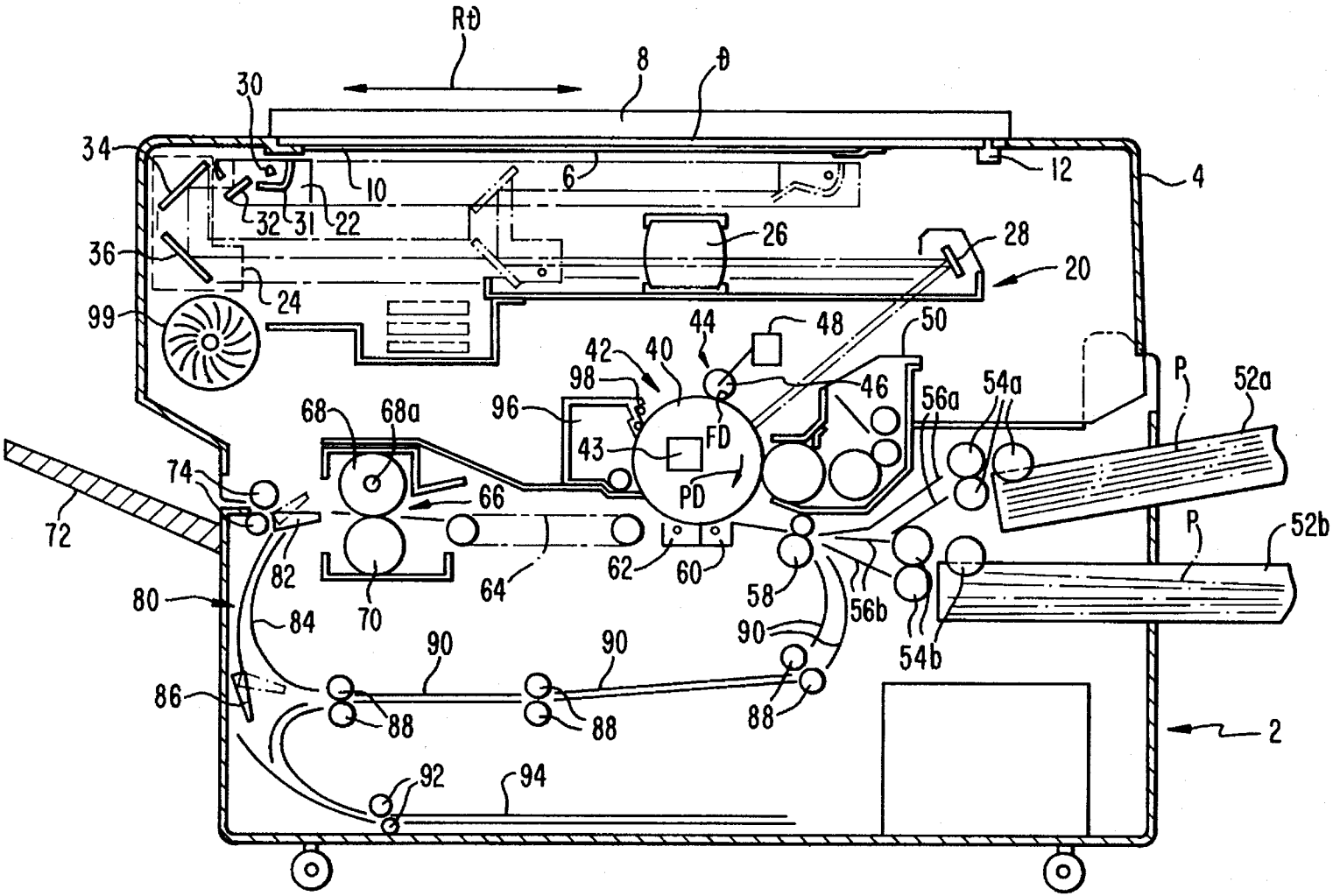
FIG. 1 is a sectional view showing the arrangement of a copying machine.

FIG. 1 shows a copying machine 2 as an image-forming apparatus according to a first embodiment of the present invention. Copying machine 2 includes a copying machine housing 4. An original table 6 which is a transparent glass is fixed on the upper surface of housing 4. An openable original cover 8 is arranged near original table 6. A fixed scale 10 for positioning an original D is arranged at one end of original table 6 along the longitudinal direction thereof. A switch 12 for detecting the opening of original cover 8 is arranged on the upper surface of housing 4.

Original D placed on original table 6 is scanned for image exposure by an optical system 20. Optical system 20 includes a first carriage 22, a second carriage 24, a lens block 26 for magnification or reduction and a mirror 28. First carriage 22 includes an exposure lamp 30, a reflector 31 for reflecting the light from exposure lamp 30 to original table 6 and a mirror 32. Second carriage 24 includes a mirror 34 and a mirror 36. When optical system 20 scans original D, original D is exposed by exposure lamp 30 while first carriage 22 and second carriage 24 reciprocate in the direction indicated by an arrow RD along the under surface of original table 6. In this case, second carriage 24 moves at a speed half that of first carriage 22 in order to maintain a fixed optical path length.

A reflected light beam from original D scanned by optical system 20 is reflected by mirror 32, mirror 34 and mirror 36, transmitted through lens block 26 and then reflected by mirror 28 to be projected on a photosensitive drum 40. Thus, an electrostatic latent image of original D is formed on the surface of photosensitive drum 40.

Photosensitive drum 40 is surrounded by an image forming unit 42 including optical system 20. Photosensitive drum 40 is rotated by a motor 43 in the direction indicated by an arrow PD so that its surface is wholly charged first by a main charger 44. Main charger 44 includes a conductive roller 46 which is contacted to the surface of photosensitive drum 40 under a predetermined pressure, and rotates in the direction indicated by an arrow FD following the rotation of photosensitive drum 40. Conductive roller 46 is supplied with a voltage from a voltage source 48. The image of original D is projected on the charged surface of photosensitive drum 40 by slit exposure, forming the electrostatic latent image on the surface. The electrostatic latent image is developed into a visible image which is a toner image by a developing unit 50 using toner. Paper sheets P as an image record media are delivered one by one from an upper paper cassette 52*a* or a lower paper cassette 52*b* by paper-supply rollers 54*a* or paper-supply rollers 54*b*, and guided along a paper guide path 56*a* or a paper guide path 56*b* to an aligning roller pair 58. Then, each paper sheet P is delivered to a transfer region by aligning roller pair 58, timed to the formation of the visible image.

Paper cassette 52*a* and paper cassette 52*b* are removably attached to the lower right end portion of housing 4, and can be alternatively selected by operation on a control panel which will be described in detail later. Paper cassette 52*a* and paper cassette 52*b* are provided, respectively, with cassette size detecting switches (not shown) which detect the selected cassette size. The detecting switches are each formed by a plurality of microswitches which are turned on or off in response to insertion of cassettes of different sizes.

Paper sheet P delivered to the transfer region comes into intimate contact with the surface of photosensitive drum 40, in the space between a transfer charger 60 and photosensitive drum 40. As a result, the toner image on photosensitive drum 40 is transferred to paper sheet P by the agency of transfer charger 60. After the transfer, paper sheet P is separated from photosensitive drum 40 by a separation charger 62 and transported by a conveyor belt 64. Thus, paper sheet P is delivered to a fixing unit 66 arranged at the terminal end portion of conveyor belt 64. Fixing unit 66 includes a heat roller 68 which has a heater lamp 68*a* and a pressure roller 70 which is arranged in contact with heat roller 68. As paper sheet P passes a nip portion between heat roller 68 and pressure roller 70, the transferred image is fixed on paper sheet P. After the fixation, paper sheet P is discharged into a tray 72 outside housing 4 by a rotation of an exit roller pair 74.

If paper sheet P, however, is to have a two-sided copying or a multiple copying, paper sheet P is sent, instead of being discharged directly to tray 72 through exit roller pair 74, into a retransporting path 80 by means of a gate unit 82. Gate unit 82 is arranged between fixing unit 66 and exit roller pair 74. Paper sheet P transported by gate unit 82 is guided by a guide 84 and transported to a gate unit 86. When paper sheet P is to have the multiple copying, gate unit 86 directs paper sheet P to aligning roller pair 58 through transporting roller pairs 88 and transporting guides 90. When paper sheet P is to have the two-sided copying, gate unit 86 guides paper sheet P to a reverse roller pair 92 and a reverse guide 94. Paper sheet P transported to reverse roller pair 92 is transported in the same direction until the rear end of paper sheet P arrives at reverse roller pair 92. After that, reversing roller pair 92 turns over and paper sheet P is transported in the direction opposite to the direction of transportation before that time and sent to aligning roller pair 58 through transporting roller pairs 88 and transporting guides 90. In this way, paper sheet P is transported to the transfer region again and the multiple copying or the two-sided copying is performed.

After the transfer, moreover, the residual toner on the surface of photosensitive drum 40 is removed by a cleaner 96. Thereafter, a residual latent image on photosensitive drum 40 is erased by a discharge lamp 98 to restore the initial state. A cooling fan 99 for preventing the temperature inside housing 4 from rising is arranged at an upper-left portion of fixing unit 66.

The construction of main charger 44 will now be described in detail.

Figure 2:
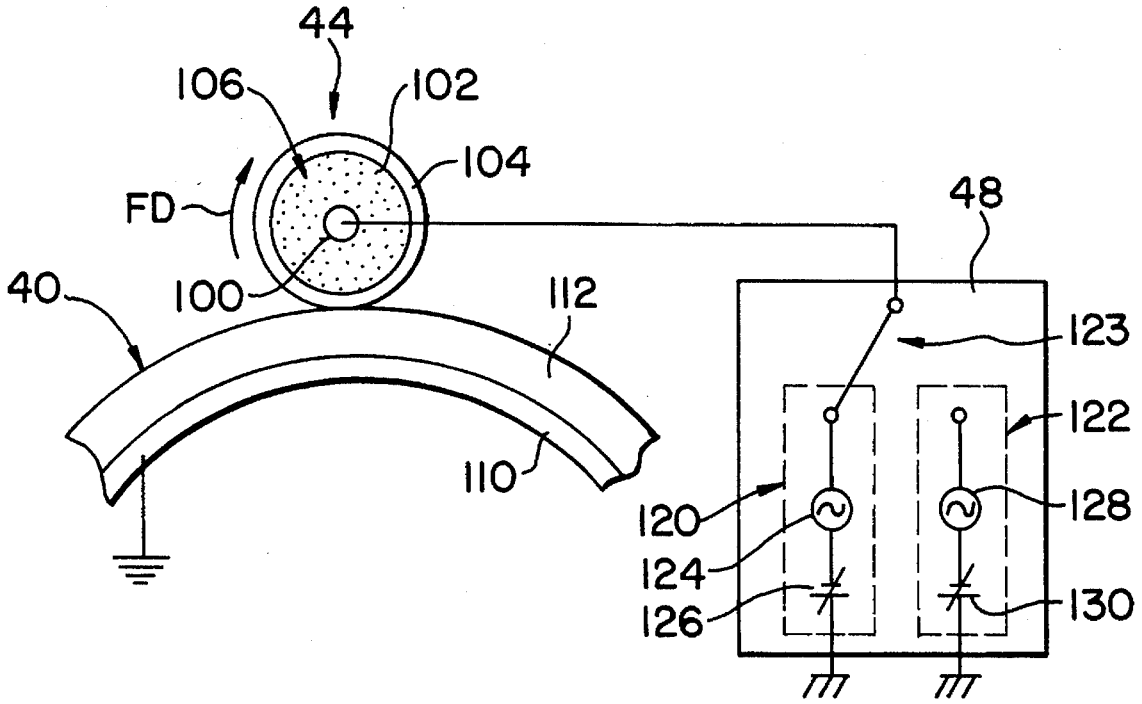
FIG. 2 is an enlarged view of a portion of the sectional view of FIG. 1.

As shown in FIG. 2 conductive roller 46 includes a metal shaft 100 whose diameter is 6.0 mm, a urethane rubber layer 102 formed on metal shaft 100, and a urethane layer 104 formed on urethane rubber 102. Urethane rubber layer 102 contains carbon particles dispersed therein so that the resistance per 1 $cm^2$ in the direction of the thickness is about $10^7 \Omega \cdot cm^2$. The thickness of urethane layer 104 is about 10 μm. Photosensitive drum 40 includes the conductive base 110 and a photosensitive layer 112 formed on the conductive base 110. Urethane layer 104 is in contact with photosensitive layer 112. The hardness of conductive roller 46 including these elements is about 45° at the rubber hardness (JIS A), and the diameter of conductive roller 46 is about 12 mm.

Voltage source 48 includes a first oscillatory voltage source 120 a second oscillatory voltage source 122, and a switch 123 for alternatively connecting first oscillatory voltage source 120 and second oscillatory voltage source 122 to conductive roller 46.

First oscillatory voltage source 120 has an AC voltage source 124 whose peak-to-peak voltage is about 2.2 KV and the frequency is about 2000 Hz and has a DC voltage source 126 whose DC voltage is about −560V. First oscillatory voltage source 120 provides conductive roller 46 with a first oscillatory voltage provided by superposing the AC and DC voltage.

Second oscillatory voltage source 122 has an AC voltage source 128 whose peak-to-peak voltage is about 12.2 KV and the frequency is about 800 Hz and has a DC voltage source 130 whose DC voltage is about −560V. Second oscillatory voltage source 122 provides conductive roller 46 with a second oscillatory voltage provided by superposing the AC and DC voltage.

Figure 3:
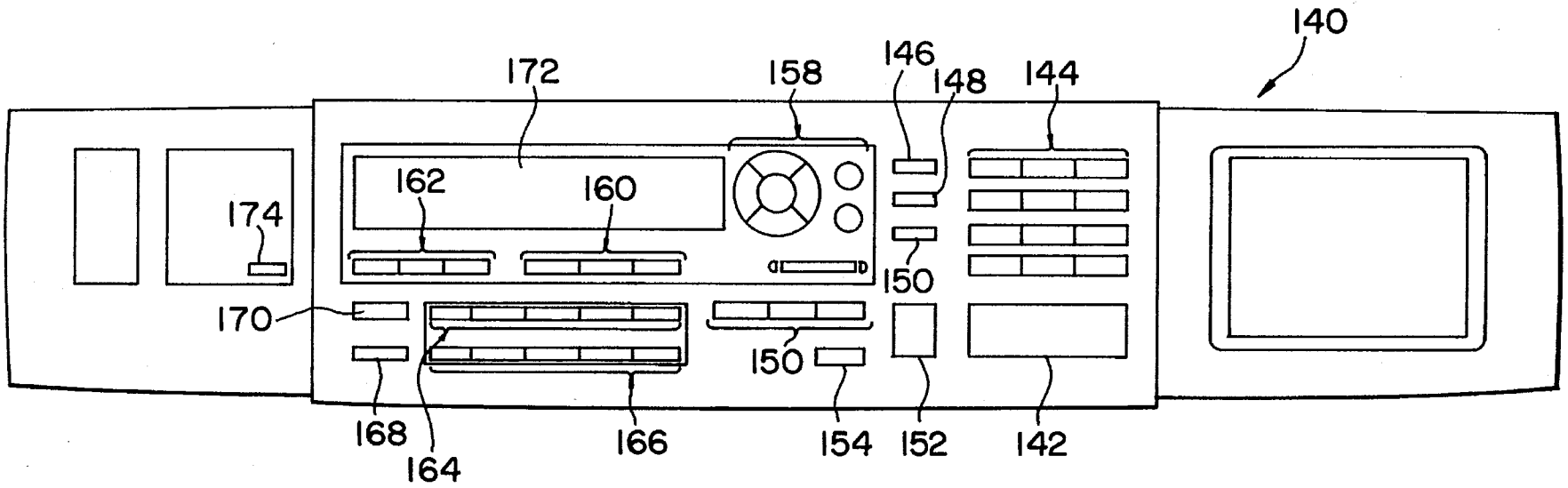
FIG. 3 is a plan view of a control panel.

Switch 123 connects first oscillatory voltage source 120 to conductive roller 46 when copying machine 2 is in a normal mode and connects second oscillatory voltage source 122 to conductive roller 46 when copying machine is in a photo mode. The photo mode is used to make clear copies of photographs and gravure. The setting of the normal mode or the photo mode is performed by operation of a control panel 140 as shown in FIG. 3.

Control panel 140 is mounted on housing 4. Control panel 140 carries thereon a copy key 142 for starting the copying operation, keys 144 for setting the number of copies to be made and the like, a function clear key 146 for setting the standard status, an energy saver key 148 for going into the energy-saving mode and turning all its display lamps off, an interrupt key 150 for making a copy of a different original during a multicopy run, and a clear/stop key 152 for clearing the copy quantity entered or stopping a multicopy run. Control panel 140 has a photo key 154 on the left side of clear/stop key 152. When photo key 154 is depressed once, copying machine 2 is set in the photo mode from the normal mode. At this time, switch 120 changes the connection to second oscillatory voltage source 122 from first oscillatory voltage source 120. If photo key 154 is depressed again, copying machine 2 is returned to the normal mode.

Control panel 140 is further provided with a density setting section 156 for setting the copy density, an editing key 158 for setting the trimming mode or masking mode and modifying characters, operation guide keys 160 for asking the appropriate operation procedure and answering the questions from copying machine 2, zoom keys 162 for adjustably setting the enlargement or reduction ratio, an original size key 164 for setting an original size, a copy size key 166 for selecting the paper sheet size, an automatic paper selection key 168 for automatically detecting the size of the original set on original table 6 and selecting a paper sheet of the same size as the original, an automatic magnification selection key 170 for automatically detecting the size of the original D set on original table 6 and calculating the correct reproduction or enlargement ratio, and a display section 172 for indicating the operating conditions of the individual parts. Additionally arranged on control panel 140 are a cassette selection key 174 for alternatively selecting upper paper cassette 52*a* and lower paper cassette 52*b*.

With the arrangement described above, the operation of copying machine 2 in the photo mode will be described in detail.

When photo key 154 on control panel 140 is turned on, copying machine 2 sets the photo mode and switch 124 connects conductive roller 46 to second oscillatory voltage source 122. In this condition, copying machine 2 starts the copying operation when copy key 142 is depressed.

Figures 4A, 4B, 4C:
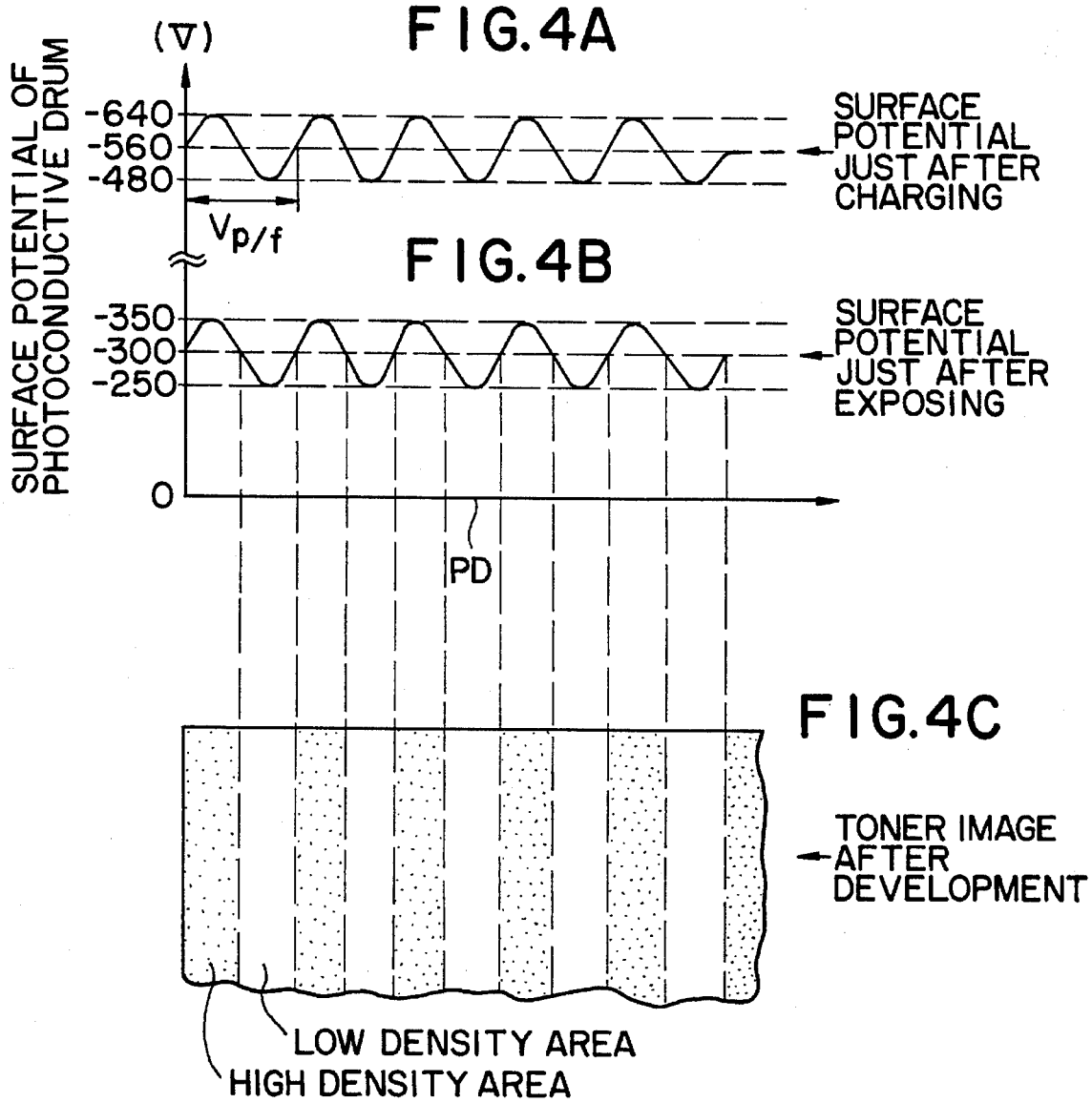
FIGS. 4(*a*) to 4(*c*) show a surface potential of a photosensitive drum and a toner image when an original image is halftone.

First, conductive roller 46 charges the surface of photosensitive drum 40. A rotating speed Vp of photosensitive drum 40 is about 125 mm/sec and the frequency of the second oscillatory voltage is about 800 Hz as described above. As a result, a Vp/f ratio which means "Vp÷f", in rotating direction PD of photosensitive drum 40 is about 0.16 mm/cycle. Namely, the potential pattern on the surface of photosensitive drum 40 is like a sine wave as shown in FIG. 4(*a*).

Then, photosensitive drum 40 charged by conductive roller 46 is exposed by optical system 20. At this time, if original D is a halftone, the potential pattern on the surface of photosensitive drum 40 is also like a sine wave as shown in FIG. 4(*b*).

Figure 5:
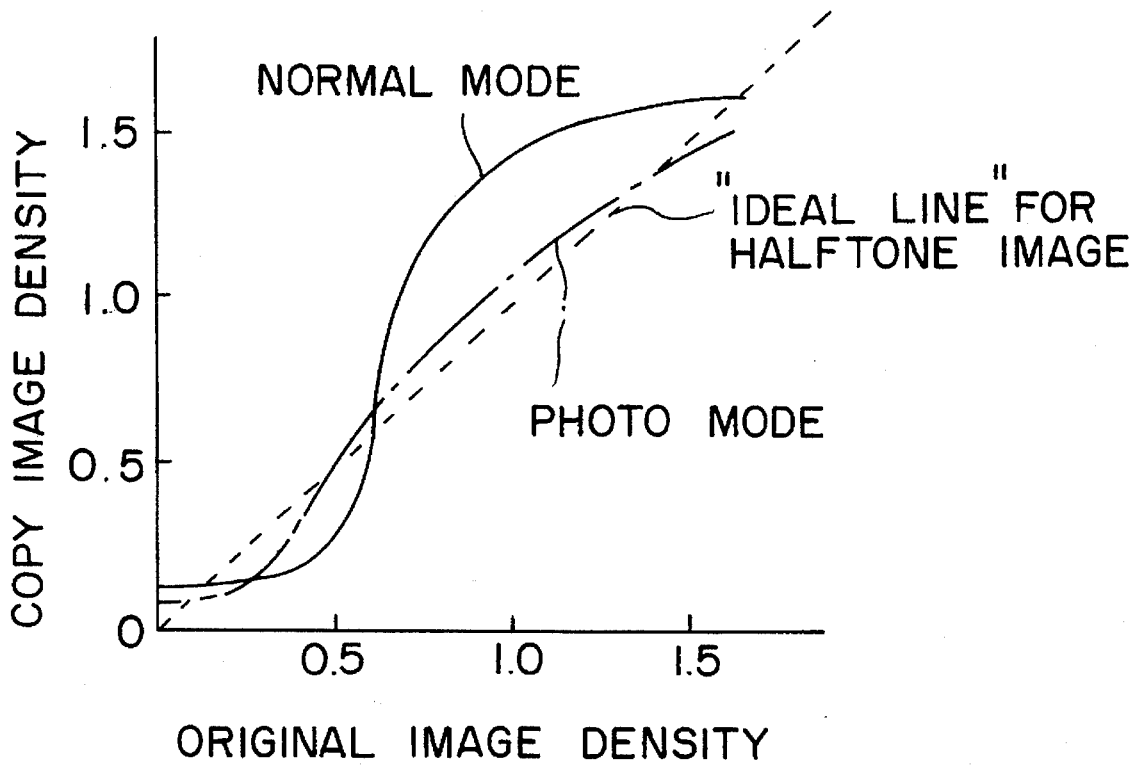
FIG. 5 is a characteristic diagram representing the relationship between original image density and copy image density.

After that, developing unit 50 supplies toner particles onto photosensitive drum 40 and the electrostatic latent image formed thereon is developed into the visible image. The image density depends on the quantity of toner particles attached on photosensitive drum 40, and the quantity of toner particles attached thereon depends on the potential level thereon. Therefore, the toner image corresponding to the potential pattern as shown in FIG. 4(*b*) is shown in FIG. 4(*c*) and a low density area and a high density area alternatively appear every 0.08 mm. This striped pattern develops a relationship between the original image density and the copy image density. When the photograph and the like is copied, ideal relationship between the original image density and the copy image density is shown as a broken line in FIG. 5. The inventors measured the copy image density of the paper sheet which the toner image is transferred by transfer charger 60 and fixed by fixing unit 66, by using the "Macbeth RD 918" manufactured by MACBETH® PROCESS MEASUREMENTS. The result of the measurement is shown in FIG. 5. A solid line is for the normal mode, and a chain line is for the photo mode. The chain line more closely approaches the ideal line as compared to the normal mode.

The principle of this phenomenon will be described in detail.

Figure 6:
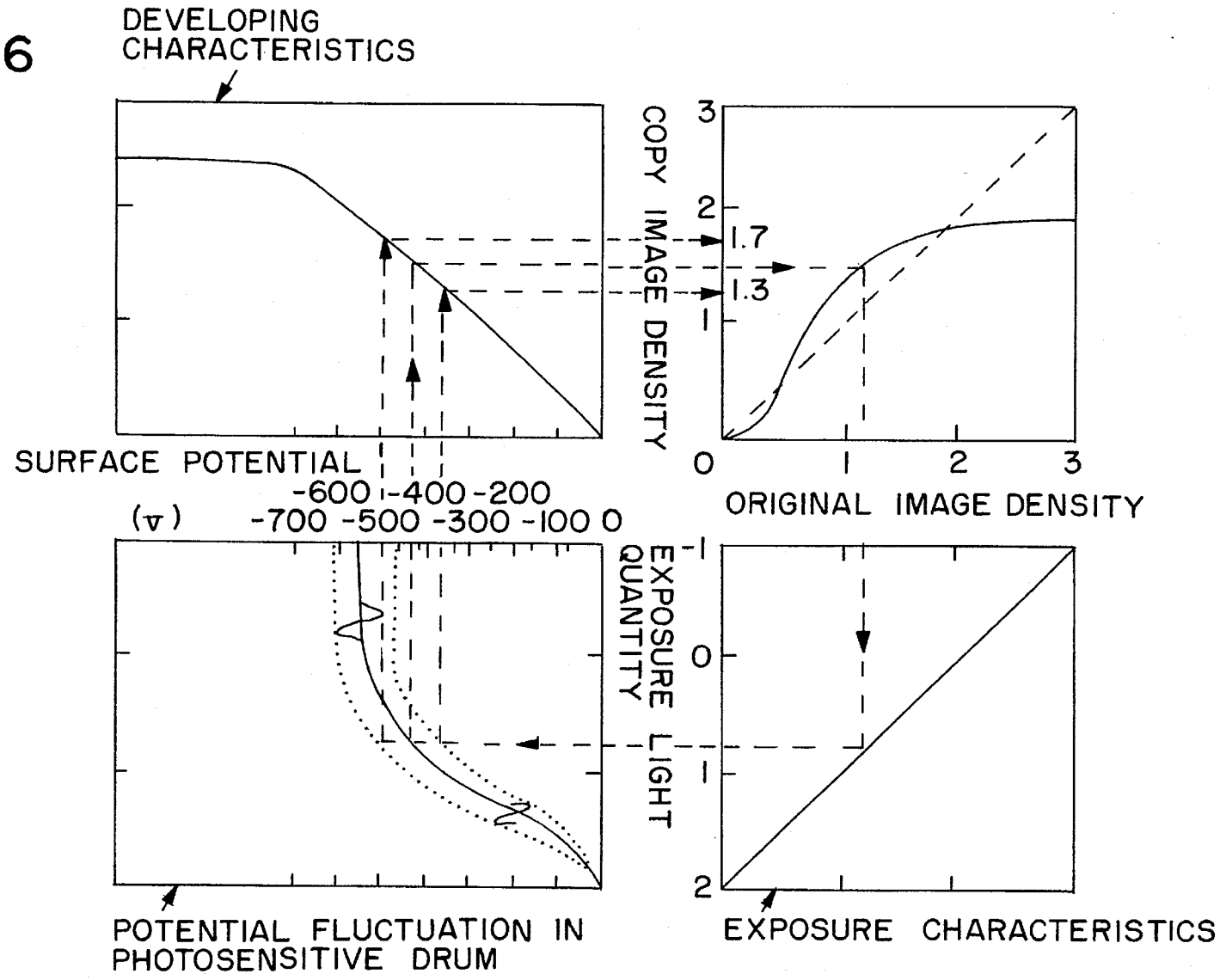
FIG. 6 is a four-quadrant chart representing the relationship between a charging process and an exposure process and developing process.

The charging process by main charger 44, the exposure process by optical system 20 and the developing process by developing unit 50 are important to photoelectrically copy some original in copying machine 2. The relationships between each process are shown in FIG. 6. The screen method of the prior art changed the exposure quantity by using a filter when the exposure system exposed the original. Thus, there were a few problems. On the contrary, copying machine 2 in this embodiment changes the frequency of the oscillatory voltage provided to conductive roller 46. This provides the change in the potential fluctuation on photosensitive drum 40. When the frequency is lower than a predetermined value, the low density area appears in the toner image after the development. For instance, when the original image density is about 1.2, which is halftone, the exposure quantity is about 0.8 and the surface potential of photosensitive drum 40 is about from −350V to 500V, and the copy image density is about from 1.3 to 1.7. The existence of the low density area such as 1.3 is very important because it approaches the relationship between the original image density and the ideal copy image density.

The inventors have performed three tests in order to find out a preferable range of the frequency by using a copying machine 2. A Test 1 was done at each frequency 200 Hz, 300 Hz, 400 Hz, 1000 Hz, 1500 Hz and 2000 Hz. The other conditions were the same as that of copying machine 2. As shown in FIG. 7, the copy image for a halftone original was good when the frequency was 400 Hz and 1000 Hz, so-so when the frequency was 300 Hz and 1500 Hz, and bad when the frequency was 200 Hz and 2000 Hz. When the frequency was 2000 Hz, there was not the low density area in the copy image and the copy image was not halftone but high density. When the frequency was 200 Hz, the low density area was so wide that the copy image was not fine. In FIG. 7, a special frequency is Vp/f, and represents a number of line pairs per one millimeter in the copy image. A line pair represents a pair of high and low density areas.

A Test 2 was almost the same test as that performed in the Test 1. In this case, the rotating speed Vp of photosensitive drum 40 was 420 mm/sec. Corresponding to the change of the rotating speed Vp, the peak-to-peak voltage by AC voltage source 128 was set about 2.0 KV and the DC voltage by DC voltage source 130 was set at about −700V. The surface potential of photosensitive drum 40 was −700V±100V just after charging by conductive roller 46 and connecting to second oscillatory voltage source 122. The Test 2 was done at each frequency f of 800 Hz, 1000 Hz, 1200 Hz, 4000 Hz, 5000 Hz, and 6000 Hz. As shown in FIG. 8, the copy image for a halftone original was good when the frequency was 1200 Hz and 4000 Hz, so-so when the frequency was 1000 Hz and 5000 Hz, and bad when the frequency was 800 Hz and 6000 Hz. When the frequency was 6000 Hz, there was no low density area in the copy image, and the copy image was not halftone but high density. When the frequency was 800 Hz, the low density area was so wide that the copy image was not fine.

In a Test 3, the rotating speed Vp of photosensitive drum 40 was 50 mm/sec. Furthermore, the exposure process and the developing process were changed. A laser beam was used as a source of light, and the latent image on photosensitive drum 40 was developed by a so-called reverse developing unit. The reverse developing unit attaches toner particles not to the charged area of the latent image but to the discharged area where the surface potential has fallen due to the laser beam. Also, corresponding to the change of the rotating speed Vp, the peak-to-peak voltage by AC voltage source 128 was set to at least about 2.0 KV and the DC voltage by DC voltage source 130 was set at about −500V. The surface potential of photosensitive drum 40 was −500V±80V just after charging by conductive roller 46 connected to second oscillatory voltage source 122. The Test 3 was done at each frequency of 100 Hz, 120 Hz, 150 Hz, 400 Hz, 500 Hz, 600 Hz and 700 Hz. As shown in FIG. 9, the copy image for a halftone original was good when the frequency was 150 Hz, 400 Hz and 500 Hz, so-so when the frequency was 120 Hz and 600 Hz, and bad when the frequency was 100 Hz and 700 Hz. When the frequency was 700 Hz, there was no low density area in the copy image, and the copy image was not halftone but high density. When the frequency was 100 Hz, the low density area was so wide that the copy image was not fine.

Figure 10:
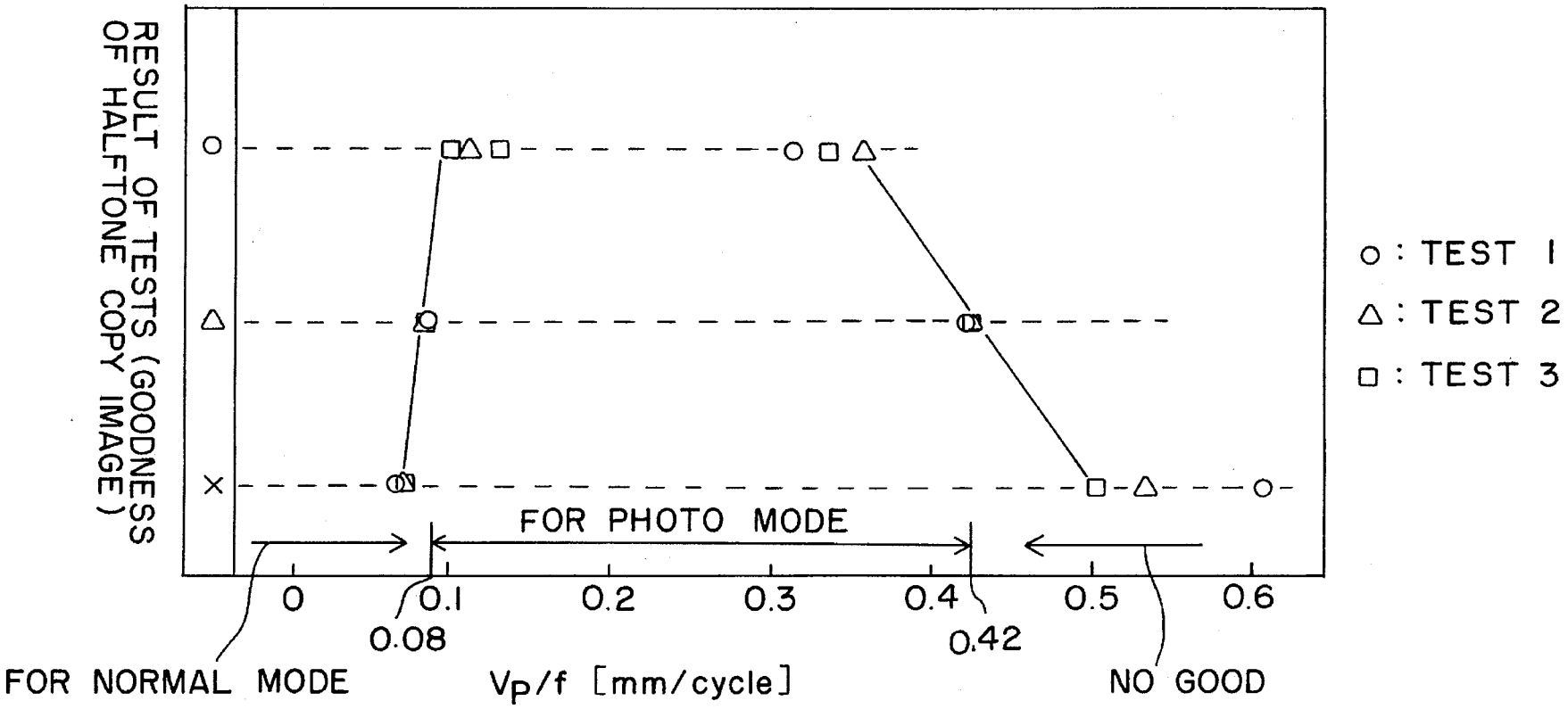
FIG. 10 shows a relationship between a goodness of copy image and a Vp/f based on the results of the TESTS 1 to 3.

As shown in FIGS. 7, 8 and 9, both the frequency f and the rotating speed Vp are very important to produce a good copy image. The relationship between the goodness of the copy image and Vp/f is shown in FIG. 10. According to FIG. 10, the frequency f and the rotating speed Vp should be set so that the Vp/f ratio is between about 0.08 and 0.42, preferably between about 0.10 and 0.33.

As shown by Test 3, this invention is applicable to an image-forming apparatus which has a reverse developing unit, as well as copying machine 2 which has the regular type by developing unit 50. The reason will be described in detail.

Figure 11A:
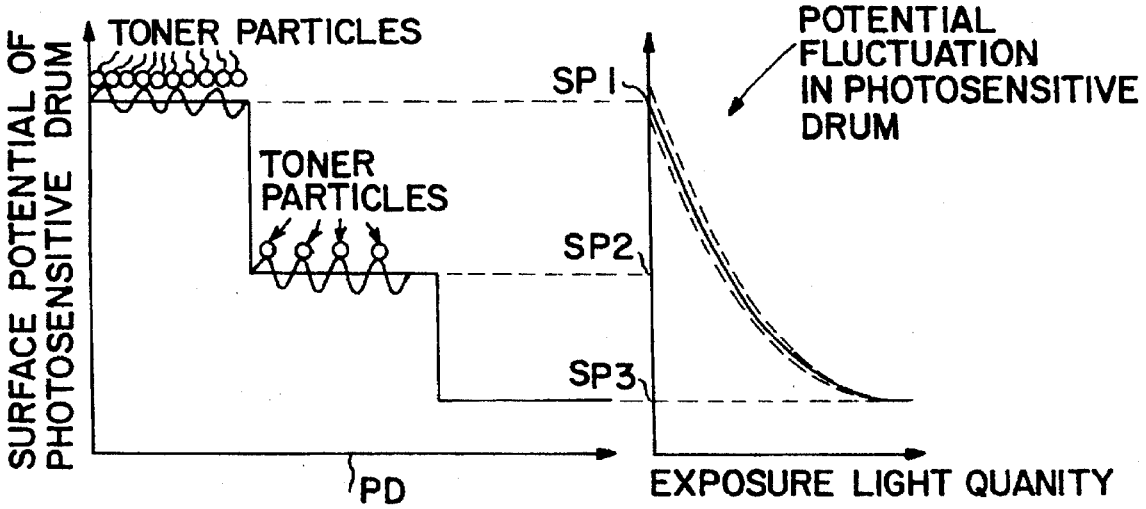
FIGS. 11(*a*) and 11(*b*) show a difference between a regular type developing process and a reverse type developing process in relationship with an attachment of toner particles to the photosensitive drum.
Figure 11B:
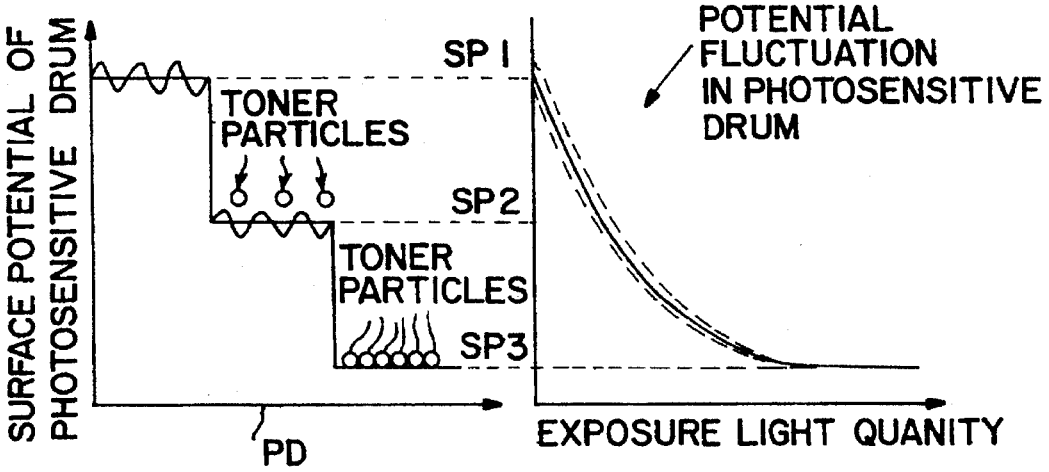

If the developing process is the regular type, the toner particles are attached to the photosensitive drum by the developing unit corresponding to the surface potential of the photosensitive drum, as shown in FIG. 11(*a*). If the developing process is the reverse type, the other particles are attached to the photosensitive drum by the developing unit, as shown in FIG. 11(*b*). The surface potential SP1 shows a potential of a non-exposure area which has not been exposed by the optical system. The surface potential SP2 shows a potential of a halftone area. The surface potential SP3 shows a potential of a discharged area, which potential has been nearly discharged by an exposure.

When the developing process is a regular type and the surface potential is SP2, the toner attached to around the upper peak portion of the surface potential is much more quantity than that attached to around lower peak portion. On the other hand, when the developing process is a reverse type and the surface potential is SP2, the toner attached to around the lower peak portion of the surface potential is much more quantity than that attached to around upper peak portion. Thus, according to this invention, the copy image for a halftone will be good irrespective of the developing type.

Figure 12:
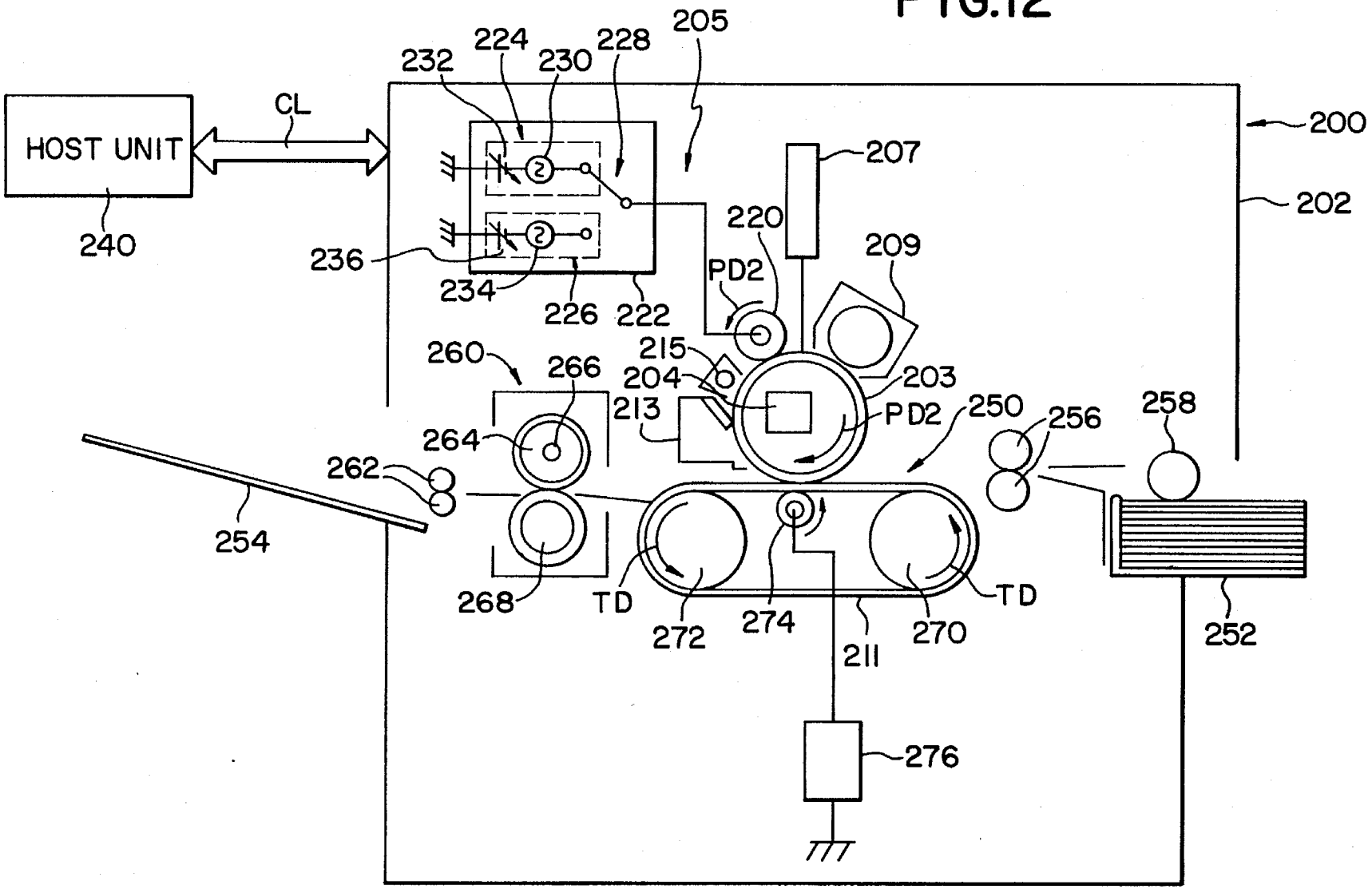
FIG. 12 is a sectional view showing the arrangement of a laser printer of a second embodiment.

FIG. 12 shows a second embodiment of the image-forming apparatus of this invention. In this embodiment, the source of light is a laser beam, the developing process is a reverse type, and the transfer process is not a corona charge transferring type but a contact belt transferring type.

As shown in FIG. 12, a laser printer 200 as an image-forming apparatus includes a housing 202 and a photosensitive drum 203 for use as an image bearing member. Photosensitive drum 203 is located substantially in the center of housing 202 so as to be rotatable in the direction of an arrow PD2 when a driving force of a motor 204 is supplied. Photosensitive drum 203 is formed of a photoconductive material based on an organic photoconductor (OPC). Photosensitive drum 203 is surrounded by a main charger 205 for charging photosensitive drum 203, a laser unit 207 for use as a electrostatic latent image forming unit, a developing unit 209 which is a reverse developing type, a transfer belt 211 doubling as a transporting member, a cleaner 213 for removing residual toner particles, and a discharge lamp 215 for erasing a residual latent image on photosensitive drum 203 to restore the initial state. Main charger 205 includes a conductive roller 220 which is contacted to the surface of photosensitive drum 203 under a predetermined pressure, and rotates in the direction indicated by an arrow FD2 following the rotation of photosensitive drum 203, as in the first embodiment. The structure of conductive roller 220 is the same as that of the first embodiment. Also, conductive roller 220 is supplied with a voltage from a voltage source 222. Voltage source 222 includes a first oscillatory voltage source 224, a second oscillatory voltage source 226 and a switch 228 for alternatively connecting first oscillatory voltage source 224 and second oscillatory voltage source 226 to conductive roller 220.

First oscillatory voltage source 224 has an AC voltage source 230 whose peak-to-peak voltage is about 2.0 KV and frequency is about 700 Hz and a DC voltage source 232 whose DC voltage is about −500V. First oscillatory voltage source 230 provides conductive roller 220 with a first oscillatory voltage provided by superposing the AC and DC voltage.

Second oscillatory voltage source 226 has an AC voltage source 234 whose peak-to-peak voltage is about 2.0 KV and frequency is about 400 Hz and a DC voltage source 236 whose DC voltage is about −500V. Second oscillatory voltage source 226 provides conductive roller 220 with a second oscillatory voltage provided by superposing the AC and DC voltage.

Switch 228 connects first oscillatory voltage source 224 to conductive roller 220 when laser printer 200 is in a normal mode and connects second oscillatory voltage source 226 to conductive roller 220 when laser printer 200 is in a photo mode. Laser printer 220 is connected to a host unit 240 serving as an external output unit, e.g., a computer or a word processor through a communications line CL. The setting of the normal mode or the photo mode is performed by a predetermined signal from host unit 240.

A paper transportation path 250 is defined in housing 202. Paper transportation path 250 is used to guide a paper sheet P taken out of a paper cassette 252 attached to one side of housing 202, to a tray 254 on the other side of housing 202 through an image transfer section between photosensitive drum 203 and transfer belt 211.

An aligning roller pair 256 is arranged on the upper-course side of paper transportation 250 with respect to the image transfer section. Aligning roller pair 256 aligns the leading edge of paper sheet P, taken out of paper cassette 252 by means of a paper supply roller 258, and then timely feeds paper sheet P into the image transfer section.

A fixing unit 260 and a discharge roller pair 262 are arranged on the lower-course side of the image transfer section. Fixing unit 260 includes a heat roller 264 which has a heater lamp 266 and a pressure roller 268 which is arranged in contact with heat roller 264. When paper sheet P passes a nip portion between heat roller 264 and pressure roller 268, these rollers 264 and 268 fix a toner image transferred to paper sheet P. Discharge roller pair 262 discharges to tray 254 the paper sheet on which the toner image is fixed.

Transfer belt 211 is an endless belt and stretched between a roller 270 and an idle roller 272 in order to rotate in the direction indicated by an arrow TD. The distance between roller 270 and idle roller 272 is about 100 mm. The width of transfer belt 211 is almost the same as that of photosensitive drum 203. An electric supply roller 274 is arranged between roller 270 and idle roller 272 in order to press transfer belt 211 to photosensitive drum 203 and rotates following the movement of transfer belt 211. Also, electric supply roller 274 is connected to a voltage source 276 which applies a transfer voltage. The toner image is transferred to the paper sheet by the transfer voltage applied from voltage source 276 through electric supply roller 274 and transfer belt 211 while transfer belt 211 transports paper sheet P. The transfer voltage is set at about 1000V. Paper sheet P in the image transfer section does not shift in both the transporting direction and the crossing direction to the transporting direction, because paper sheet P is held by electric supply roller 274 and photosensitive drum 203, and adheres to transfer belt 211 by the electrostatic force which voltage source 276 causes.

Transfer belt 211 includes heat hardenability polyimido of 75 weight % and carbon particles of 25 weight %. The thickness of transfer belt 211 is about 100 μm and the resistance per 1 $cm^2$ in the direction of the thickness is about $10^{11}\Omega\cdot cm^2$. This resistance is measured as follows. First, transfer belt 211 is sandwiched between two identical 1 kg electrodes and have a square measure of 7.1 $cm^2$. The electrodes are made from stainless steel. Then, an electric voltage of 500V is applied to one of the two electrodes. Finally, an electric current value flowing in the other electrode is measured and the resistance is calculated. It is possible to substitute resin for the material of transfer belt 211, such as polycarbonate, polyethylenetelephtalate, polytetra-fluoro-ethylen, poly-vinylidenfluoride or resin composed of alloy-polymer.

With the arrangement described above, the operation of laser printer 200 in the photo mode will be described in detail.

When the signal for setting the photo mode is sent from host unit 240, laser printer 200 sets the photo mode and switch 228 connects conductive roller 220 to second oscillatory voltage source 226. In this condition, when a print start signal is sent from host unit 240, laser printer 200 starts the printing operation.

First, conductive roller 220 charges the surface of photosensitive drum 203. The rotating speed Vp of photosensitive drum 203 is about 50 mm/sec. Thus, the Vp/f ratio in the rotating direction PD2 of photosensitive drum 203 is about 0.13 mm/cycle. Photosensitive drum 203, charged by conductive roller 220, is exposed by laser unit 207. After that, developing unit 209 supplies toner particles onto photosensitive drum 203 and the electrostatic latent image formed thereon is developed into the toner image so that the toner image is subjected to the reverse development. The developed toner image is transported to the image transfer section.

In the meantime, paper sheet P, taken out from paper cassette 252 by means of paper supply roller 258, is delivered to the image transfer section by means of aligning roller pair 256 in synchronism with the rotation of photosensitive drum 203. The toner image on the surface of photosensitive drum 203 is electrostatically attracted and transferred to paper sheet P by the electric field which voltage source 276 causes. After the transfer process, paper sheet P is delivered to fixing unit 260 and then, discharged to tray 254 by discharge roller pair 262.

In this embodiment, as the source of light is a laser beam, it is easy to adjust the light quantity in order to make a halftone image. Thus, the halftone image made by laser printer 200 is finer than that made by copying machine 2.

The source of light is laser unit 207 in this embodiment. However, it is possible to substitute an LED array, a fluorescent substance array or light source with many liquid crystal shutters.

The invention is not limited to the first embodiment and the second embodiment. For example, five modifications of the main charger are shown in FIGS. 13 to 17.

Figure 13:
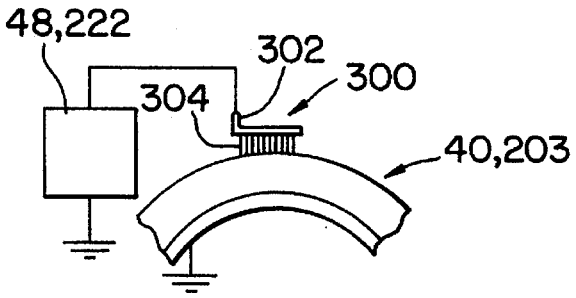
FIG. 13 is a sectional view showing a main charger of a third embodiment.

FIG. 13 shows a third embodiment of the image-forming apparatus, especially the main charger of this invention. A main charger 300 includes a metal plate 302 and a conductive brush 304 planted to the surface of metal plate 302. Metal plate 302 is connected to voltage source 48 or 222. Conductive brush 304 is in contact with photosensitive drum 40 or 203.

Figure 14:
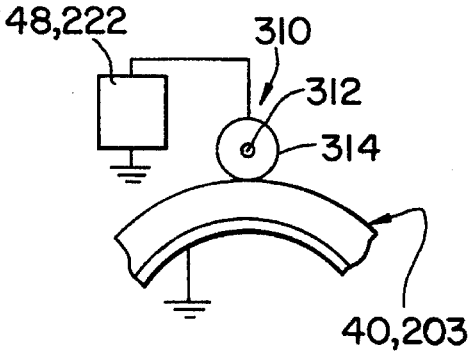
FIG. 14 is a sectional view showing a main charger of a fourth embodiment.

FIG. 14 shows a fourth embodiment of the image-forming apparatus, especially the main charger, of this invention. A main charger 310 includes a metal shaft 312 and a conductive brush 314 planted to the surface of metal shaft 312. Metal shaft 312 is connected to voltage source 48 or 222. Conductive brush 314 is in contact with photosensitive drum 40 or 203. Metal shaft 312 with conductive brush 314 rotates in the direction following the rotation of photosensitive drum 40 or 203.

Figure 15:
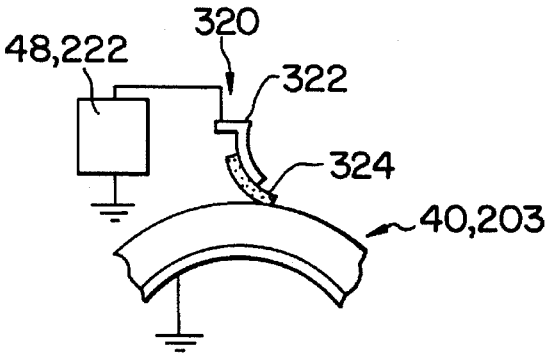
FIG. 15 is a sectional view showing a main charger of a fifth embodiment.

FIG. 15 shows a fifth embodiment of the image-forming apparatus, especially the main charger, of this invention. A main charger 320 includes a metal plate 322 and a plate-like conductive elastic body 324 adhered to the surface of metal plate 322. Metal plate 322 is connected to voltage source 48 or 222. One end portion of conductive elastic body 324 is in connection with photosensitive drum 40 or 203.

Figure 16:
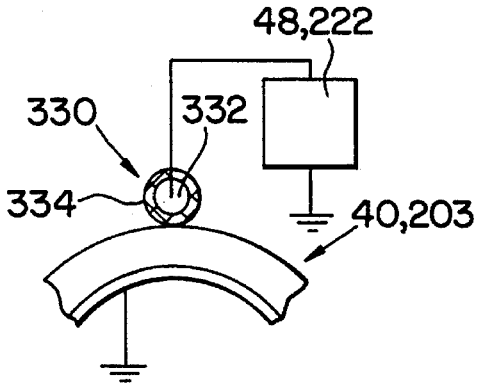
FIG. 16 is a sectional view showing a main charger of a sixth embodiment.

FIG. 16 shows a sixth embodiment of the image-forming apparatus, especially the main charger, of this invention. A main charger 330 includes a metal shaft 332 and a conductive web 334 adhered to the surface of metal shaft 332. Metal shaft 332 is connected to voltage source 48 or 222. Conductive web 334 is in contact with photosensitive drum 40 or 203. Metal shaft 332 with conductive web 334 rotates in the direction following the rotation of photosensitive drum 40 or 203.

Figure 17:
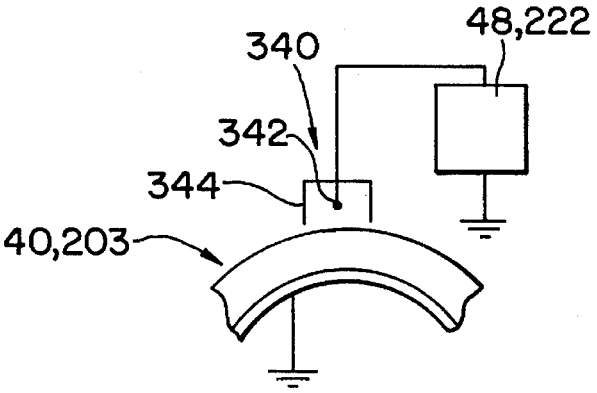
FIG. 17 is a sectional view showing a main charger of a seventh embodiment.

FIG. 17 shows a sixth embodiment of the image-forming apparatus, especially the main charger, of this invention. A main charger 340 shown in FIG. 17 is a so-called corona charger and includes an electrode 342 and a conductive shield case 344. Electrode 342 is connected to voltage source 48 or 222. Electrode 342 and shield case 344 are apart from the surface of photoconductive drum 48 or 222. Electrode 342 discharges the oscillatory voltage from the voltage source 48 or 222 to photosensitive drum 40 or 203. When main charger 340 is arranged in copying machine 2 or laser printer 200, DC voltage sources 126 and 130 or DC voltage sources 276 and 232 are set at about 4 KV to 5 KV.

Additional advantages and modifications will readily occur to those skilled in the art. Therefore, the invention in its broader aspects is not limited to specific details, representative devices, and illustrated examples shown and described herein. Accordingly, various modifications may be made without departing from the spirit or scope of the general inventive concept as defined by the appended claims and their equivalents.

What is claimed is:

1. An image-forming apparatus for forming an image by using a photosensitive member, comprising:

means for charging a photosensitive member;

means for relatively moving the charging means and the photosensitive member;

first applying means for applying to the charging means a first oscillatory voltage such that a Vp/f ratio is about less than 0.08 mm/cycle, wherein the Vp represents a relative moving speed between the charging means and the photosensitive member and the f represents a frequency of the first oscillatory voltage;

second applying means for applying a second oscillatory voltage to the charging means such that a Vp/f ratio is about from 0.08 to 0.42 mm/cycle;

means for alternatively setting the image-forming apparatus to a normal mode and a halftone mode, the normal mode being for a character image and the halftone mode being for a halftone image;

means for connecting the first supplying means to the charging means when the normal mode is set, and connecting the second applying means to the charging means when the halftone mode is set;

means for exposing the charged photosensitive member to form an electrostatic latent image; and means for developing the electrostatic latent image.

2. The image-forming apparatus according to claim 1, wherein each of the first applying means and the second applying means includes an AC voltage source and a DC voltage source, and each of the first oscillatory voltage, and the second oscillatory voltage is provided by superposing an AC voltage from the AC voltage source and a DC voltage from the DC voltage source.

3. The image-forming apparatus according to claim 1, wherein the Vp/f ratio of the second oscillatory voltage is about from 0.10 to 0.33 mm/cycle.

4. The image-forming apparatus according to claim 1, wherein the charging means includes a contacting member to contact the photosensitive member.

5. The image-forming apparatus according to claim 1, wherein the charging means includes an electrode, which does not contact the photosensitive member, for discharging corresponding to receiving the first oscillatory voltage or the second oscillatory voltage.

6. The image-forming apparatus according to claim 2, wherein a level of a peak-to-peak voltage of the AC voltage source of the first applying means is substantially equal to a level of a peak-to-peak voltage of the AC voltage source of the second applying means, and a level of a DC voltage of the DC voltage source of the first applying means is substantially equal to a level of a DC voltage of the DC voltage source of the second applying means.

7. An image-forming method for forming an image using a photosensitive member, comprising the steps of:

moving a charging member and a photosensitive member relative to each other;

applying a first oscillatory voltage to the charging member to charge the photosensitive member in a normal mode such that a Vp/f ratio is less than about 0.08 mm/cycle, wherein the Vp represents a relative moving speed between the charging member and the photosensitive member and the f represents a frequency of the first oscillatory voltage;

applying a second oscillatory voltage to the charging member to charge the photosensitive member in a halftone mode such that a Vp/f ratio is about from 0.08 to 0.42 mm/cycle;

exposing the charged photosensitive member to form an electrostatic latent image; and developing the electrostatic latent image.

* * * * *